US008407829B2

(12) United States Patent
Vogel

(10) Patent No.: US 8,407,829 B2
(45) Date of Patent: Apr. 2, 2013

(54) COUPLING FOR A FAUCET LIFT ROD

(75) Inventor: John David Vogel, Columbus, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 1055 days.

(21) Appl. No.: 11/998,712

(22) Filed: Nov. 30, 2007

(65) Prior Publication Data

US 2009/0139025 A1 Jun. 4, 2009

(51) Int. Cl.
*E03C 1/23* (2006.01)

(52) U.S. Cl. ..... 4/689; 4/690; 4/691; 4/692; 4/693

(58) Field of Classification Search ..... 4/679, 680, 4/684, 685, 688–693
See application file for complete search history.

(56) References Cited

U.S. PATENT DOCUMENTS

| | | | |
|---|---|---|---|
| 166,045 | A | 7/1875 | Weaver |
| 179,003 | A | 6/1876 | Doyle et al. |
| 432,658 | A | 7/1890 | Weaver |
| 439,818 | A | 11/1890 | Hale |
| 447,232 | A | 2/1891 | Croswell |
| 484,423 | A | 10/1892 | Hale |
| 514,214 | A | 2/1894 | Croswell |
| 524,989 | A | 8/1894 | Hale |
| 539,203 | A | 5/1895 | Totham |
| 541,845 | A | 7/1895 | Gilcher |
| 629,628 | A | 7/1899 | Totham |
| 634,347 | A | 10/1899 | Hooper |
| 636,727 | A | 11/1899 | Hinsdale |
| 641,126 | A | 1/1900 | Lewis |
| 645,639 | A | 3/1900 | Bunting, Jr. |
| 654,600 | A | 7/1900 | Bunting, Jr. |
| 667,443 | A | 2/1901 | Jansen |
| 711,238 | A | 10/1902 | Totham |
| 756,663 | A | 4/1904 | Lewis |
| 767,450 | A | 8/1904 | Soderlund |
| 921,230 | A | 5/1909 | Goehle, Sr. |
| 922,253 | A | 5/1909 | Bunting, Jr. |
| 925,245 | A | 6/1909 | Storey |
| 941,797 | A | 11/1909 | Miller |
| 948,033 | A | 2/1910 | Allingham |
| 955,456 | A | 4/1910 | Geurink |
| 1,028,374 | A | 6/1912 | McGuire et al. |
| 1,035,849 | A | 8/1912 | Bergens |
| 1,036,022 | A | 8/1912 | Speakman |
| 1,048,823 | A | 12/1912 | Graham |
| 1,071,515 | A | 8/1913 | Foster |
| 1,148,456 | A | 7/1915 | Kenney |
| 1,226,879 | A | 5/1917 | Hamm et al. |
| 1,245,943 | A | 11/1917 | Miller |

(Continued)

FOREIGN PATENT DOCUMENTS

| | | |
|---|---|---|
| CN | 1639427 | 7/2005 |
| WO | WO 03/066977 | 8/2003 |

OTHER PUBLICATIONS

Plumb Shop, Model SF0354, Sm Ss Pop Up Clev Clip, at least as early as Aug. 20, 2007, 1 pg.

(Continued)

*Primary Examiner* — Gregory Huson
*Assistant Examiner* — Lauren Heitzer
(74) *Attorney, Agent, or Firm* — Faegre Baker Daniels LLP

(57) ABSTRACT

A drain assembly for use with a faucet including a lift rod, a lever arm, and a coupler operably coupling the lift rod and the lever arm.

19 Claims, 4 Drawing Sheets

U.S. PATENT DOCUMENTS 1,254,897 A 1/1918 Frankenberger et al.
1,255,389 A 2/1918 Cornelius
1,258,371 A 3/1918 Speakman
1,333,826 A 3/1920 Yeiser et al.
1,462,853 A 7/1923 Dehn
1,474,986 A 11/1923 Watrous
1,479,944 A 1/1924 Vallier
1,483,850 A 2/1924 Kaufman
1,485,669 A 3/1924 Davis
1,500,416 A 7/1924 Mueller et al.
1,579,564 A 4/1926 Niedecken
1,597,459 A 8/1926 Muend
1,607,507 A 11/1926 Blauvelt
1,610,812 A 12/1926 Ottke
1,647,188 A 11/1927 Mueller et al.
1,677,791 A 7/1928 Mueller et al.
1,678,102 A 7/1928 Bresler
1,710,289 A 4/1929 Bresler
1,758,226 A 5/1930 Kaufman
1,766,712 A 6/1930 Johnson
1,848,521 A 3/1932 Fleck
1,859,697 A 5/1932 Fleck
1,918,515 A 7/1933 Beste
1,960,278 A 5/1934 Niedecken
1,965,085 A 7/1934 Rankin
1,980,250 A 11/1934 Baxter
2,063,632 A 12/1936 Schneider
2,091,553 A 8/1937 Mallet
2,137,496 A 11/1938 Klein
2,147,839 A 2/1939 Hagerty
2,179,121 A 11/1939 Frank et al.
2,317,898 A 4/1943 Fensch et al.
2,689,959 A 9/1954 Holycross, Jr. et al.
2,768,388 A 10/1956 Smith
2,833,574 A 5/1958 Fife
3,002,196 A 10/1961 Mackey, Jr.
3,080,570 A 3/1963 Weddendorf, Jr.
3,125,764 A 3/1964 Young
3,169,254 A 2/1965 Lantz et al.
3,263,243 A 8/1966 Doyle
3,283,340 A * 11/1966 McMartrie et al. ..... 4/584
3,314,085 A 4/1967 Minella
3,315,279 A * 4/1967 Nolan ..... 4/687
3,353,192 A 11/1967 Christiansen
3,419,919 A 1/1969 Stayner
3,731,326 A 5/1973 Politz
3,763,504 A 10/1973 Parsons
4,192,026 A 3/1980 Williams
4,218,785 A 8/1980 Crawford et al.
4,577,349 A 3/1986 Clegg
4,698,858 A 10/1987 Kostorz
4,903,943 A 2/1990 Hochstrasser
5,022,429 A 6/1991 Rollini et al.
5,333,327 A * 8/1994 Redding et al. ..... 4/693
5,509,150 A 4/1996 Bergmann et al.
5,640,724 A 6/1997 Holmes
5,787,521 A 8/1998 O'Connell et al.
5,797,151 A 8/1998 Ko
5,819,337 A 10/1998 Bergmann
5,822,812 A 10/1998 Worthington et al.
5,979,489 A 11/1999 Pitsch
5,996,143 A 12/1999 Lordahl et al.
6,023,795 A 2/2000 Pötter et al.
6,023,796 A 2/2000 Pitsch
6,061,847 A 5/2000 Jourdan
6,138,296 A 10/2000 Baker
6,161,230 A 12/2000 Pitsch
6,170,098 B1 1/2001 Pitsch
6,256,810 B1 7/2001 Baker
6,308,351 B1 10/2001 Franke
6,360,770 B1 3/2002 Buchner et al.
6,367,102 B1 4/2002 McMullen et al.
6,484,330 B2 11/2002 Gray et al.
6,491,058 B1 12/2002 Wang
6,725,472 B2 4/2004 Gray et al.
6,904,623 B2 6/2005 Ohta et al.
6,973,685 B2 12/2005 Duncan
7,055,545 B2 6/2006 Mascari et al.
2001/0052150 A1 12/2001 Onoue
2003/0041374 A1 3/2003 Franke
2005/0066440 A1 3/2005 Fischl
2006/0080773 A1 4/2006 McNerney et al.
2006/0179564 A1 8/2006 Jacobs
2006/0200904 A1 9/2006 Vogel et al.
2007/0044232 A1 3/2007 McNerney et al.
2007/0271695 A1 11/2007 Thomas et al.
2008/0023085 A1 1/2008 Rosko et al.

OTHER PUBLICATIONS

BrassCraft, Model PS2344; Lava Pop-Up Ctr Piece Assembly, at least as early as Aug. 20, 2007, 1 pg.
Drawing of known lift rod coupling, at least as early as Aug. 20, 2007, 1 pg.

* cited by examiner

COUPLING FOR A FAUCET LIFT ROD

BACKGROUND AND SUMMARY OF THE INVENTION

The present invention relates generally to faucets and, more particularly, to a drain assembly for use with a faucet including a lift rod coupling.

Conventional lavatory faucets are often coupled to a pop-up drain assembly. Such drain assemblies typically include a pull or lift rod extending in a generally vertical direction from below the sink deck upwardly to a position above the faucet. A lower end of the lift rod is usually coupled to a lever arm wherein raising and lowering of the lift rod by a user from above the sink deck causes corresponding pivoting movement of the lever arm to raise and lower a drain plug positioned within the sink basin.

Conventional faucets and drain assemblies typically require the installer to connect most of the components from below the sink deck in often cramped and dimly lit work areas. More particularly, the installer typically has the awkward task of attaching the lever arm to the lift rod. The installer often must reach up high under the sink deck with a wrench to install and to adjust the lever arm of the drain assembly to the lift rod.

According to an illustrative embodiment of the present disclosure, a drain assembly for use with a faucet includes a lift rod, a lever arm, and a coupler. The coupler includes a center portion, an upper leg connected to the center portion and extending laterally in the first direction, and a lower leg extending laterally in the first direction. The upper leg includes a first opening and the lower leg includes a second opening alignable with the first opening for receiving the lift rod. The upper leg and the lower leg are biased away from each other. The coupler further includes a receiver receiving the lever arm.

According to a further illustrative embodiment of the present disclosure, a drain assembly for use with a faucet includes a lift rod defining a first axis and a lever arm defining a second axis. A coupler includes a center portion extending substantially parallel to the first axis, an upper leg connected to the center portion and extending laterally in a first direction and longitudinally up, and a lower leg extending laterally in the first direction and longitudinally down. The upper leg includes a first opening and the lower leg includes a second opening alignable with the first opening for receiving the lift rod. The coupler further includes a receiver extending laterally in the first direction and including an opening to receive the lever arm such that the second axis is substantially perpendicular to the first axis.

According to another illustrative embodiment of the present disclosure, a coupler for a drain assembly includes a center portion, an upper leg connected to the center portion and extending laterally in the first direction, and a lower leg connected to the center portion and extending laterally in the first direction. The upper leg and the lower leg are biased away from each other. The upper leg includes a first opening, and the lower leg includes a second opening alignable with the first opening to receive a lift rod. A receiver extends laterally in the first direction and includes an opening configured to receive a lever arm.

According to another illustrative embodiment of the present disclosure, a method of connecting a drain assembly includes the steps of providing a coupler and placing a lever arm within a receiver of the coupler. The method further includes the steps of pinching the opposing legs of the coupler thereby aligning openings formed within the legs, inserting a lift rod within the openings of the legs of the coupler, and releasing the opposing legs of the coupler such that the legs frictionally engage the lift rod.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
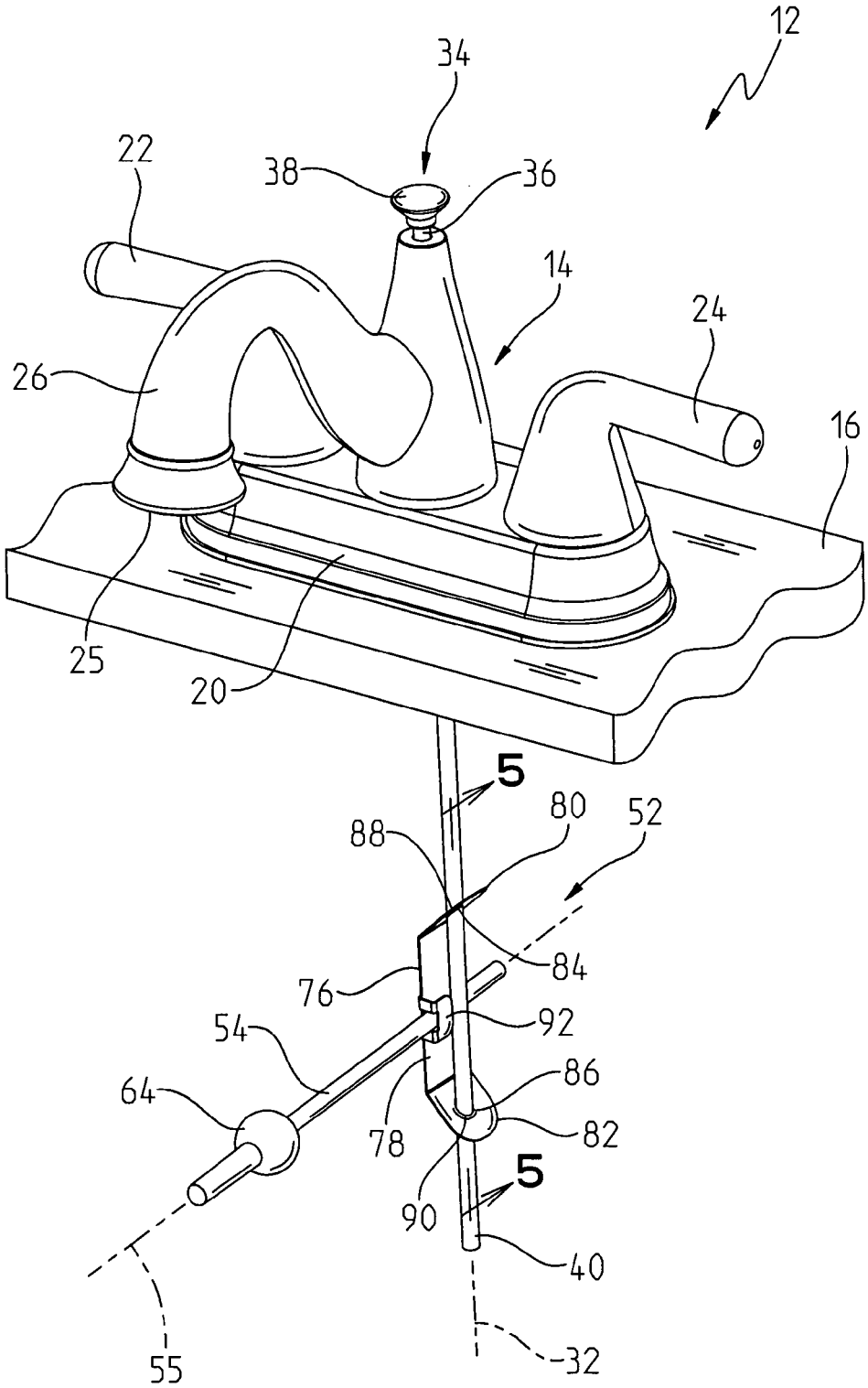
FIG. 1 is a top perspective view of an illustrative embodiment coupler coupling a faucet lift rod to a lever arm.
Figure 2:
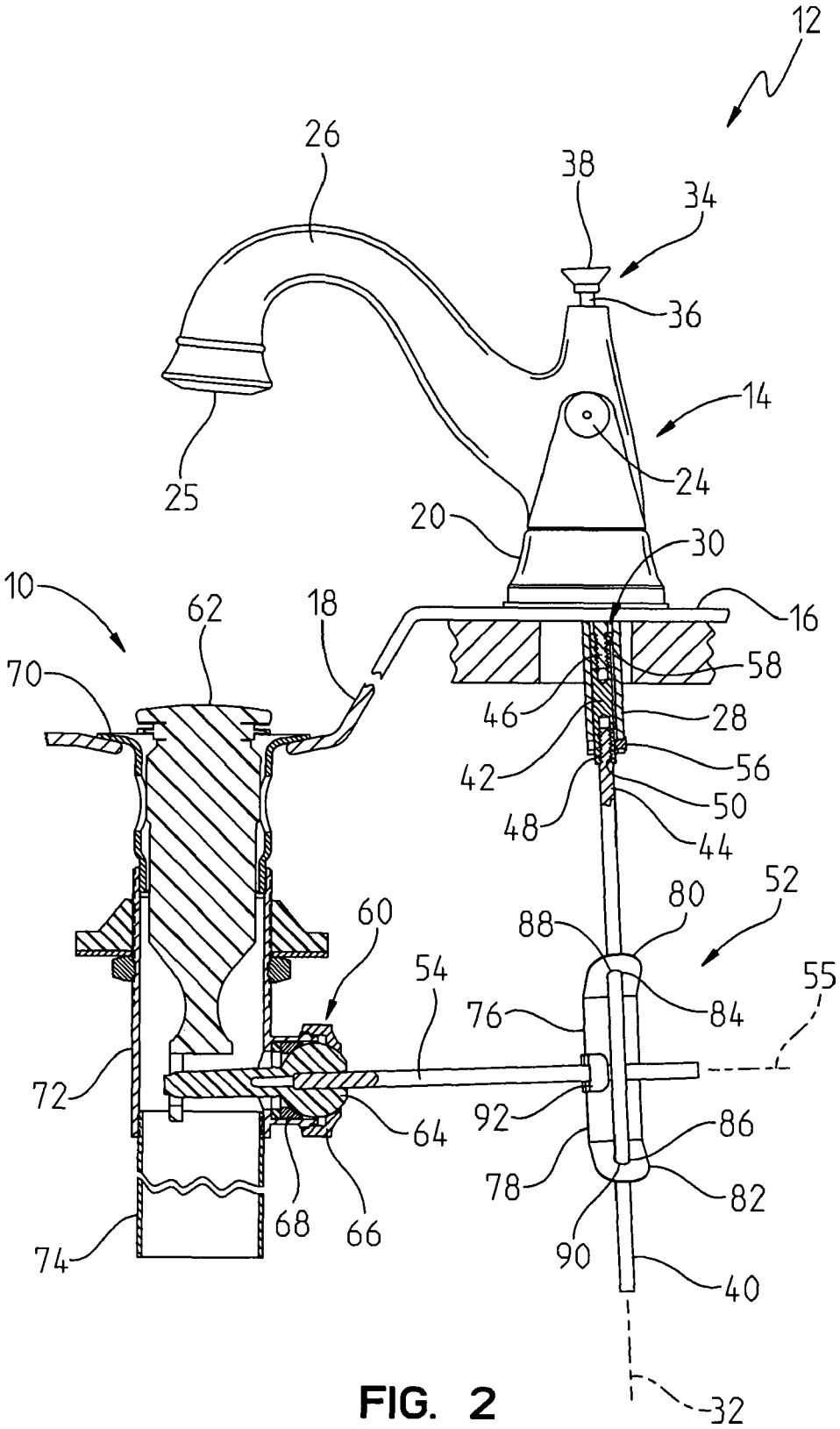
FIG. 2 is a side elevational view, in partial cross-section, of an illustrative drain assembly coupled to a faucet.

Referring initially to FIGS. 1 and 2, an illustrative embodiment drain assembly 10 for use with a faucet 12 is shown as including an upper faucet assembly 14 positioned above a mounting base 16, illustratively a sink deck supporting a sink basin 18. The upper faucet assembly 14 illustratively includes an escutcheon or body housing 20. Hot and cold water handles 22 and 24 are positioned above the escutcheon 20 and are operably coupled to hot and cold water control valves (not shown). As is known in the art, rotating the hot and cold water handles 22 and 24 adjusts the hot and cold water control valves to control the flow of water delivered to the outlet 25 of a delivery spout 26.

A retainer 28 is coupled to the upper faucet assembly 14 and defines a lift rod passageway 30 having a longitudinal axis 32. A lift rod 34 is illustratively supported for sliding movement along the axis 32 within the lift rod passageway 30 defined by the retainer 28. The lift rod 34 includes an upper member 36 supporting a handle 38. A lower member 40 is connected to the upper member 36 through a lift rod coupler 42. More particularly, an upper end 44 of the lower member 40 and a lower end 46 of the upper member 36 are coupled to opposing upper and lower ends of the coupler 42, respectively. The lower member 40 and the upper member 36 may be fixed to the coupler 42 through conventional means, such as friction fits, threads, adhesives, etc. In the illustrative embodiment, the upper member 36 is releasably coupled to the coupler 42. More particularly, the lower end 46 of the upper member 36 includes a plurality of external threads 48 configured to engage a plurality of internal threads 50 formed within the upper end of the coupler 42.

A drain coupler 52 operably couples the lower member 40 of the lift rod 34 to a pivot or lever arm 54 of the drain assembly 10. The lever arm 54 defines a longitudinal axis 55 extending substantially perpendicular to the longitudal axis 32 of the lift rod 34. The lift rod coupler 42, and hence the upper member 36 and the lower member 40 of the lift rod 34 are supported for sliding axial movement within the lift rod passageway 30. A lower stop is illustratively defined by a set screw 56 received within the side wall of the retainer 28 and is configured to engage a lip 58 for limiting downward movement of the coupler 42. In other words, engagement between set screw 56 and the lip 58 provides a limit stop for downward movement of the coupler 42, thereby preventing the coupler 42 from falling out of the bottom of the retainer 28 when the upper member 36 has been removed.

As detailed herein, the lift rod 34 is operably coupled to the lever arm 54 of the drain assembly 10 through the drain coupler 52. The lever arm 54 is configured to pivot about a pivot seat 60 in order to raise and lower a stopper or plug 62 coupled to the lever arm 54. More particularly, the pivot seat 60 illustratively includes a truncated ball 64 supported for pivoting movement about a pivot nut 66 and cooperating pivot base 68. The plug 62 is received for movement within a flange 70 supported by the sink basin 18. The flange 70 is in communication with a tubular drain body 72 which is in fluid communication with a tail piece 74 for coupling to a conventional drain pipe (not shown).

Figure 3:
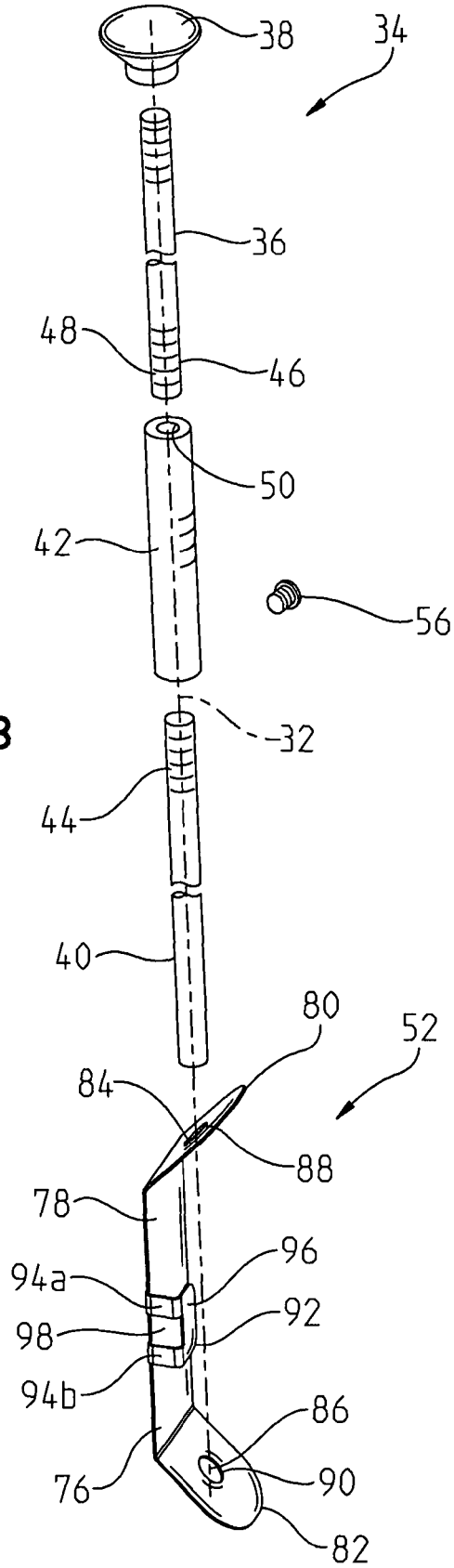
FIG. 3 is an exploded perspective view of a faucet lift rod and coupler of FIG. 1.
Figure 4:
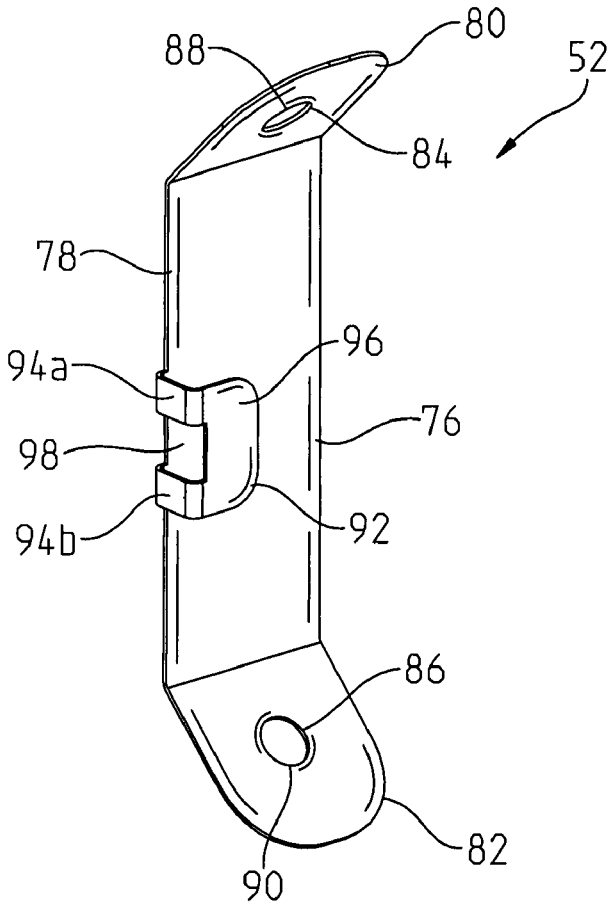
FIG. 4 is a perspective view of the coupler of FIG. 1.
Figure 5:
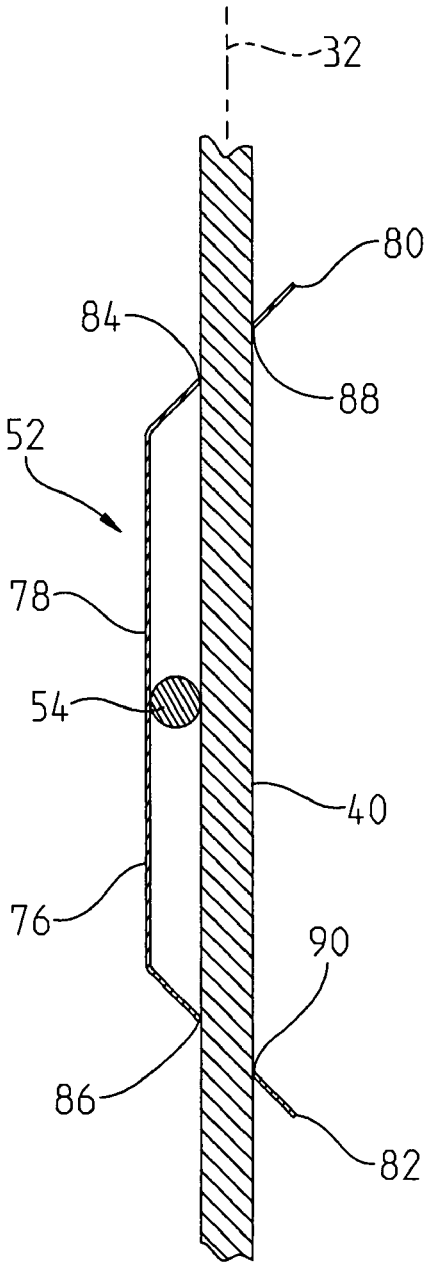
FIG. 5 is a cross-sectional view taken along line 5-5 of FIG. 1.

With reference to FIGS. 3-5, the drain coupler 52 includes a clip body 76 having a center portion 78 and integrally formed upper and lower legs 80 and 82. Both the upper leg and the lower leg 82 extend laterally in a first direction such that the body substantially defines a "C" shape in elevation. The upper leg 80 and the lower leg 82 are biased away from each other. More particularly, in the illustrative embodiment the clip is formed from spring steel such that the upper leg 80 is biased upwardly and the lower leg is biased downwardly 82. In other illustrative embodiments, other resilient materials may be used to form the coupler 52, such as molded polymers. The upper leg 80 includes a first opening 84 while the lower leg 82 includes a second opening 86. The first and second openings 84 and 86 are selectably alignable such that the lower member 40 of the lift rod 34 may be received therethrough. The spring bias of the upper and lower legs 80 and 82 causes an outer edge 88 and 90 of each opening 84 and 86 to frictionally engage the lower member 40 of the lift rod 34 such that the coupler 52 is secured thereto.

The upper leg 80 is angled upwardly relative to the center portion 78 of the body 76, and the lower leg 82 is angled downwardly relative to the center portion 78 of the body 76. In the illustrative embodiment, the upper leg 80 and the lower leg 82 are both angled vertically from the center portion 78 by approximately 45 degrees.

The drain coupler 52 further includes a receiver 92 integrally formed with the center portion 78. The receiver 92 illustratively includes a pair of legs 94*a* and 94*b* coupled to an inwardly extending tab 96. An opening 98 is defined by the legs 94*a* and 94*b* and the tab 96 for slidably receiving the lever arm 54. As with the center portion 78 and the legs 80 and 82, the receiver 92 is illustratively integrally formed from spring steel. In one illustrative embodiment, a single piece of spring steel is stamped and formed to define the drain coupler 52.

The method of connecting the drain assembly 10 to the faucet 12 includes the steps of placing the lever arm 54 within the receiver 92 of the coupler 52 and pinching the opposing legs 80 and 82 of the coupler 52 to align the openings 84 and 86. The lift rod 34 may then be inserted into the aligned openings 84 and 86 of the coupler legs 80 and 82. By releasing the opposing legs 80 and 82 of the coupler 52, the legs 80 and 82 frictionally engage the lift rod 34. More particularly the outer edges 88 and 90 of the openings 84 and 86 frictionally engage the lower member 40 of the lift rod 34. The position of the lever arm 54 may be simply adjusted by again pinching the opposing legs 80 and 82 of the coupler 52 and then slidably moving the coupler 52 along the longitudal axis 32 of the lift rod 34.

In operation, when a user of the lift rod 34 raises or lowers handle 38, the upper member 36 and the lower member 40, through coupler 42, also move up or down along the longitudal axis 32. Frictional engagement with the legs 80 and 82 of the drain coupler 52 causes pivoting movement of the lever arm 54 by way of the receiver 92. Movement of the lever arm 54 results in lowering or raising of the plug 62.

Although the invention has been described in detail with reference to certain preferred embodiments, variations and modifications exist within the spirit and scope of the invention as described and defined in the following claims.

The invention claimed is:

1. A drain assembly for use with a faucet, the drain assembly comprising:

a lift rod;

a lever arm; and a coupler including a center portion, an upper leg connected to the center portion and extending laterally in a first direction, a lower leg connected to the center portion below the upper leg and extending laterally in the first direction, the upper leg including a first opening and the lower leg including a second opening alignable with the first opening for receiving the lift rod, the upper leg and the lower leg being biased away from each other for frictionally engaging the lift rod, the coupler further including a receiver extending laterally in the first direction from the center portion and receiving the lever arm, the receiver including a first leg, a second leg, a tab coupled to the first leg and the second leg, and an opening defined between the first leg, the second leg, and the tab, such that the lever arm is received within the opening and is positioned vertically intermediate the upper leg and the lower leg of the coupler and horizontally intermediate the center portion of the coupler and the lift rod.

2. The drain assembly of claim 1, wherein the receiver, the upper leg, and the lower leg are integral with the center portion of the coupler.

3. The drain assembly of claim 2, wherein the coupler is formed of spring biased steel.

4. The drain assembly of claim 1, wherein the receiver extends laterally in the same direction as the upper and lower legs.

5. The drain assembly of claim 1, wherein the upper leg is angled upwardly relative to the center portion of the body, and the lower leg is angled downwardly relative to the center portion of the body.

6. The drain assembly of claim 4, wherein the upper leg and the lower leg are angled from the center portion by approximately 45 degrees.

7. The drain assembly of claim 1, wherein the lift rod includes a lower member, an upper member, and a lift rod coupler coupled to the upper member and the lower member.

8. The drain assembly of claim 1, further comprising a drain plug operably coupled to the lever arm such that movement of the lift rod causes corresponding movement of the drain plug.

9. A drain assembly for use with a faucet, the drain assembly comprising:

a lift rod defining a first axis;

a lever arm defining a second axis; and a coupler including a center portion extending substantially parallel to the first axis, an upper leg connected to the center portion and extending laterally in a first direction and longitudinally up, and a lower leg extending laterally in the first direction and longitudinally down, the upper leg and the lower leg being biased away from each other, the upper leg including a first opening having an outer edge and the lower leg including a second opening having an outer edge and alignable with the first opening for receiving the lift rod, the bias of the upper leg and the lower leg causing the outer edges of the first opening and the second opening to frictionally engage the lift rod, the coupler further including a receiver extending laterally in the first direction from the center portion and including a first leg spaced apart from a second leg to define an opening to receive the lever arm such that the second axis is substantially perpendicular to the first axis and the lever arm is horizontally intermediate the center portion of the coupler and the lift rod.

10. The drain assembly of claim 9, wherein the coupler is formed of spring biased steel.

11. The drain assembly of claim 9, wherein the receiver, the upper leg, and the lower leg are integral with the center portion of the coupler.

12. The drain assembly of claim 9, wherein the lift rod includes a lower member, an upper member, and a lift rod coupler coupled to the upper member and the lower member.

13. The drain assembly of claim 9, further comprising a drain plug operably coupled to the lever arm such that movement of the lift rod causes corresponding movement of the drain plug.

14. A coupler for a drain assembly, the coupler comprising:

a center portion;

an upper leg connected to the center portion and extending laterally in a first direction, the upper leg including a first opening;

a lower leg extending laterally in the first direction, the upper leg and the lower leg being biased away from each other, the lower leg including a second opening alignable with the first opening to receive a lift rod; and a receiver extending laterally in the first direction from the center portion and including a first leg spaced apart from a second leg to define an opening configured to receive a lever arm, the lever arm configured to be positioned horizontally intermediate the center portion and the lift rod, wherein the coupler includes a first state and a second state, the upper leg and the lower leg being biased away from each other in the first state, and the upper leg and the lower leg being pinched toward each other to resist the biasing away from each other in the second state such that the first opening is aligned with the second opening to receive the lift rod in the second state and frictionally engage the lift rod in the first state.

15. The coupler of claim 14, wherein the receiver, the upper leg, and the lower leg are integral with the center portion.

16. The coupler of claim 15, wherein the center portion, the receiver, the upper leg, and the lower leg are formed of spring biased steel.

17. The coupler of claim 14, wherein the upper leg and the lower leg are angled from the center portion by approximately 45 degrees.

18. A method of connecting a drain assembly comprising the steps of:

providing a coupler including a center portion and opposing upper and lower legs connected to the center portion, the upper and lower legs having a bias away from each other;

placing a lever arm within a receiver of the coupler, the receiver including a first leg, a second leg, a tab coupled to the first leg and the second leg, and an opening defined between the first leg, the second leg, and the tab, such that the lever arm is received within the opening and is positioned vertically intermediate the opposing upper and lower legs of the coupler and horizontally intermediate the center portion of the coupler and a lift rod;

pinching the opposing upper and lower legs of the coupler to oppose the bias thereby aligning openings formed within the legs;

inserting the lift rod within the openings of the legs of the coupler; and releasing the opposing legs of the coupler to allow the bias of the legs to frictionally engage the lift rod.

19. The method of claim 18, further comprising the step of slidably adjusting the coupler along the lift rod by pinching the opposing legs, thereby adjusting the position of the lever arm.

* * * * *